US005271144A

United States Patent [19]

Barker

[11] Patent Number: 5,271,144

[45] Date of Patent: Dec. 21, 1993

[54] COIL COATING OF SHEET METAL TO PROVIDE LOCALIZED CORROSION PROTECTION

[75] Inventor: John R. Barker, Portsmouth, R.I.

[73] Assignee: ES Products, New Rochelle, N.Y.

[21] Appl. No.: 912,622

[22] Filed: Jun. 29, 1992

[51] Int. Cl.[5] ..... B21G 3/26; B05D 1/28

[52] U.S. Cl. ..... 29/527.2; 29/414; 118/211; 118/221; 427/210; 427/211; 427/286; 427/287; 470/34

[58] Field of Search ..... 427/210, 211, 286, 287; 118/211, 221, 222, 212; 470/34; 29/412, 413, 414, 527.2

[56] References Cited

U.S. PATENT DOCUMENTS

| | | | |
|---|---|---|---|
| 896,751 | 8/1908 | Norton | 427/286 |
| 2,225,778 | 12/1940 | Hallman | 427/287 |
| 2,226,006 | 12/1940 | Maze | 411/453 |
| 2,326,455 | 8/1943 | Gray | 411/914 X |
| 2,550,060 | 4/1951 | Gisondi | 411/451 X |
| 2,824,663 | 2/1958 | Fischer | 411/903 X |
| 3,064,621 | 11/1962 | Gore | 118/211 |
| 3,128,548 | 4/1964 | Zelisko | 29/527.2 |
| 3,466,967 | 9/1969 | Hallock | 411/477 |
| 3,710,672 | 1/1973 | Hallock . | |
| 3,878,756 | 4/1975 | Hallock . | |
| 4,025,671 | 5/1977 | Creamer | 427/210 |
| 4,206,264 | 6/1980 | Kurr | 411/439 X |
| 4,213,373 | 7/1980 | Hallock . | |
| 4,356,217 | 10/1982 | Wollam et al. | 427/286 |
| 4,467,515 | 8/1984 | Howie, Jr. | 29/527.2 |
| 4,627,207 | 12/1986 | Young et al. . | |
| 4,641,471 | 2/1987 | Young et al. . | |
| 4,641,472 | 2/1987 | Young et al. | 411/477 X |
| 4,813,833 | 3/1989 | Haab | 411/903 X |
| 4,964,774 | 10/1990 | Lat et al. | 411/446 |

FOREIGN PATENT DOCUMENTS

| | | | |
|---|---|---|---|
| 2220260 | 2/1973 | Fed. Rep. of Germany | 118/221 |
| 54-25539 | 8/1979 | Japan | 427/286 |
| 58-3667 | 1/1983 | Japan | 427/286 |
| 2-310356 | 12/1990 | Japan | 427/286 |
| 2184187 | 6/1987 | United Kingdom | 411/903 |

*Primary Examiner*—Terry J. Owens
*Attorney, Agent, or Firm*—Dowell & Dowell

[57] ABSTRACT

A method of providing localized corrosion protection to products manufactured of sheet metal wherein coils of sheet metal are passed through a coil coating line wherein one or more stripes of corrosion resistant material are applied to selected areas along both the upper and lower surfaces of the metal prior to the metal being cut, punched, or bent to form a product having predetermined portions of its surface area coated. In one embodiment, a selected corrosion resistant coating is applied to galvanized sheet metal prior to the metal being punched and formed into sheet metal fasteners having coated heads but uncoated shanks.

4 Claims, 2 Drawing Sheets

COIL COATING OF SHEET METAL TO PROVIDE LOCALIZED CORROSION PROTECTION

CROSS REFERENCE TO RELATED APPLICATIONS

This application is related to copending application Ser. No. 07/701,843, filed May 17, 1991 entitled, SHEET METAL FASTENERS WITH COATED HEADS in the name of Peter Hallock and John Barker, now U.S. Pat. No. 5,125,779.

BACKGROUND OF THE INVENTION

1. Field of the Invention

This invention is generally directed to a process of applying corrosion resistant coatings to products manufactured of sheet metal and more particularly to such a process wherein coil coating techniques are utilized to provide corrosion resistance to selected areas of a coil of sheet metal through the application of one or more stripes of corrosion resistant coating(s) along the upper and lower surface of the metal. The process of the present invention provides for the selective application of corrosion resistant coatings to sheet metal products prior to their being cut, stamped, bent or otherwise formed from a coil of sheet metal so that only those surfaces of the product being formed which require corrosion protection are coated thereby substantially conserving resources in the manufacturing process and decreasing cost of product manufacture.

In a preferred embodiment, coils of galvanized sheet metal are selectively coated with corrosion resistant material along portions of their upper and lower surfaces after which the metal is cut and formed into sheet metal nails of the type disclosed in applicant's copending application Ser. No. 07/701,843 so that only the heads of the fasteners are coated leaving the galvanized material on the legs or shanks uncoated for purposes of promoting chemical bonding between the nails and cementitious materials into which such fasteners are driven.

2. History of the Related Art

Heretofore, products manufactured from sheet metal which had to be treated to provide corrosion resistance were either preformed and then dipped in a bath of corrosion resistant material or sprayed to apply a corrosion resistant coating. The first such process required large vats of corrosion resistant chemicals to be maintained into which products could be dipped after which the products were removed and allowed to dry. The drawbacks of such a process include the exposure of large quantities of potentially harmful chemicals to the atmosphere thereby creating a potentially hazardous and unsafe work environment. In addition, coatings often drip from parts or products after being dipped thereby creating a waste control problem and further contributing to work-place contamination. Also, such coating processes create an immense waste of expensive corrosion resistant coating materials by applying the coatings to an entire product in instances where only portions of the product require corrosion protection.

In spraying applications, the same environmental contamination and hazardous work-place conditions are created. Particles of corrosion resistant coatings are released into the atmosphere requiring complex exhaust systems to remove caustic and toxic chemicals from the air to protect workers' health. Such systems require expensive filters to remove the chemicals so that damage to the surrounding environment by the release of such chemicals into the atmosphere is effectively prevented. Although this type of coating allows a more selective application of the coating material to a product, there remains a large quantity of waste which is sprayed on portions of the product which do not require the coating and a large amount of spray which also does not contact the product and thus must be recovered or cleaned from work areas.

In order to overcome many of the drawbacks of dip and spray coating techniques in the painting industry, a technology was developed for priming and coating sheet metals prior to their being cut, shaped or otherwise formed into an end product. The process involved is known in the industry as "coil coating" which is a method of cleaning, treating, priming, painting and finishing sheet metal prior to its being processed into an end product thereby eliminating the need for in-plant coating lines in manufacturing facilities. In a conventional coil coating process a coil of raw sheet metal is unwound and thereafter cleaned and rinsed as it is continuously drawn towards a coating area. Conventionally, the sheet metal is chemically pretreated after being cleaned and rinsed in order to prepare the surface for accepting a coating such as a primer or paint. Such coil coating processes may be utilized to apply selective coatings of different materials to both the upper and lower surface of the sheet metal in a continuous process. After the sheet metal has been coated, it is passed through ovens where the coatings are cured. The sheet metal is thereafter recoiled for shipment to end users. In some instances, the material, following its coating, may be cut or slit into sheets or smaller coils depending upon the exact end use of the sheet metal.

Although coil coating has been utilized in the industry to provide primer or finish paint coats on sheet metals such techniques have not been utilized to provide predetermined and localized corrosion protection to materials which will thereafter be cut and shaped to form end products such as flat metal fasteners utilized in the roofing industry. Generally, coil coating techniques provide for coating the entire upper and lower surfaces of metal and not predetermined or selected areas of the metal during the coating process.

SUMMARY OF THE INVENTION

This invention is directed to a method for applying corrosion resistant coatings to predetermined and selected surface portions of sheet metal prior to its being formed into an end product. In the preferred embodiment, the sheet metal is passed through a coil coating line wherein one or more stripes of corrosion resistant material are applied in aligned relationship to selected areas along both the upper and lower surfaces of the metal prior to the metal being cut, punched, bent, or otherwise processed into an end product. The types of corrosion resistant coating materials which may be utilized may vary as long as the consistency of the material allows it to be applied to sheet metal in a conventional coil coating machine and thereafter cured or dried.

Although the process of the present invention may be utilized to provide corrosion resistance to selected portions of substantially any product manufactured from sheet metal, in one preferred embodiment, the process is utilized to selectively coat sheet metal in one or more stripes from which sheet metal nails are punched and formed so that the heads of the sheet metal nails are coated but the shanks thereof are not coated.

It is the primary object of the present invention to provide a process for selectively coating sheet metal to provide corrosion resistance to end products which will be cut, stamped, or otherwise formed from the sheet metal after it is coated so as to preserve coating materials and reduce cost of product production.

It is another object of the present invention to provide a process for applying localized corrosion resistant coatings to sheet metal utilizing a process which will reduce possible environmental contamination, increase work-place safety, reduce secondary material handling costs and preserve resources through the controlled and selective us of chemical coating materials.

DESCRIPTION OF THE PREFERRED EMBODIMENT

Figure 1:
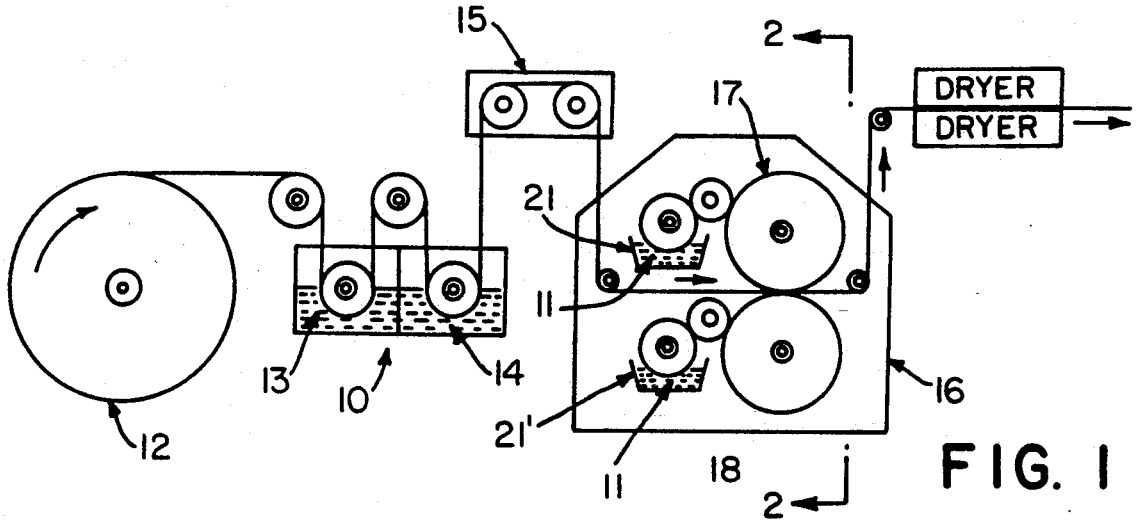
FIG. 1 is a schematic illustrational view of a coil coating line utilized in accordance with the teachings of the present invention.

With continued reference to the drawing figures, the process of the present invention is directed to selectively coating portions of sheet metal prior to the metal being utilized in the production of an end product. In the discussion set forth hereinbelow, one example of an end product will be used, however, it should be understood that any end product wherein selective corrosion resistant coating is necessary falls within the teachings of the present invention.

Figure 2:
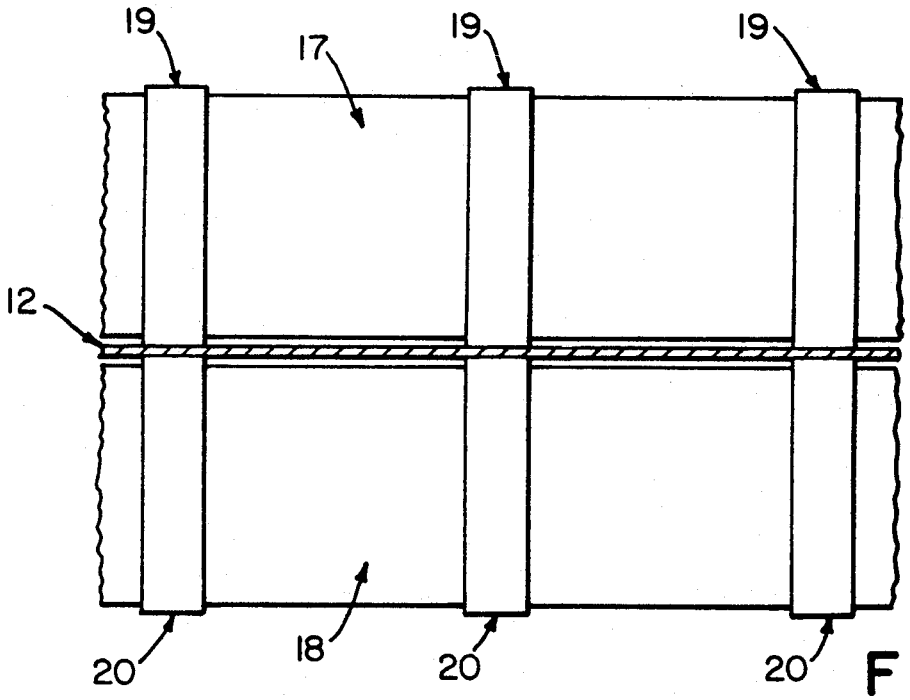
FIG. 2 is an enlarged section taken along line 2—2 of FIG. 1 showing the coating rollers for applying stripes of corrosion resistant coatings to sheet metal passing therethrough in accordance with the teachings of the present invention.

In FIG. 1 there is shown in an illustrational view a coil coating line 10 by way of which corrosion resistant materials 11 will be applied selectively to portions of the upper and lower surfaces of a coil 12 of sheet metal as the sheet metal passes through the coating line. Various types of known corrosion resistant coatings may be applied. The sheet metal initially passes through a cleaning tank 13 and then through an etching tank 14 where the metal is treated to receive coatings to be applied later in the coating process. Thereafter, the sheet metal passes through a first drying oven 15 and then into the main coating area 16. As shown in FIG. 2, the main coating area includes upper and lower rollers 17 and 18 having enlarged diameter coating surface portions 19 and 20. The coating surfaces 19 and 20 are disposed about the periphery of the rollers 17 and 18 and extend slightly outwardly therefrom. The material of which the coating surfaces are made may vary although it is designed to accept and retain corrosion resistant coating materials 11 supplied thereto either from upper or lower baths 21 and 21' via a series of rollers associated with each bath, as shown in FIG. 1.

Figure 3:
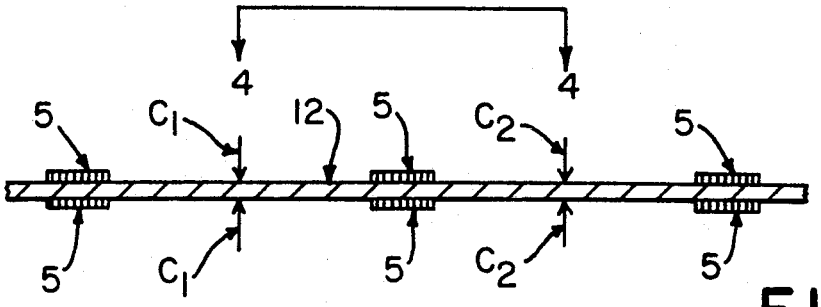
FIG. 3 is an enlarged cross sectional view of the sheet metal showing the coatings applied as the sheet metal passes between the rollers of FIG. 2.

As shown in FIG. 2, as the sheet metal passes between the rollers 17 and 18 the upper and lower surfaces thereof will be coated at pre-determined locations by contact with the coating surface portions 19 and 20 of the rollers. In most embodiments the areas being coated along the upper and lower surfaces of the sheet metal are aligned with one another as shown in FIG. 2. However, in some instances, it may be desired to apply the stripe or stripes of coating from the coating surfaces 19 and 20 to only the upper or lower surface. With reference to FIG. 1, this could be accomplished by not supplying coating materials 11 in either the upper or lower bath 21 and 21'. As the sheet metal passes between the rollers, corrosion resistant materials are selectively applied to either the upper or lower surfaces so that when the sheet metal exits the coating tank 16 a selective and pre-determined pattern of corrosion resistant coating has been applied thereto, as is shown in FIG. 3. Thereafter the sheet metal passes through an appropriate oven or drier so that the corrosion resistant coatings are cured. The sheet metal is then rewound and cut or slit as desired.

With specific reference to FIGS. 3–6, one end product manufactured utilizing sheet metal which has been selectively coated with corrosion resistant materials will be described in greater detail. The end product is a sheet metal nail 30 having a head 31 and a pair of spreadable legs or shanks 32 and 33. As previously discussed and as disclosed in applicants co-pending application Ser. No. 07/701,843, such sheet metal fasteners are generally constructed of a galvanized sheet metal which is selectively coated using a urethane coating for example, so that after being cut and punched, only the head and a small portion of the legs or shanks are coated with the corrosion resistant material. Such fasteners are utilized in roofing construction wherein the fasteners are designed to be driven into cementitious materials. The galvanized coating along the shank portions of the fasteners have been found to chemically react with the cementitious materials therefore it is necessary that such portions of the fastener not be coated with any type of supplemental coating so as to not compromise the fastener's withdrawal resistance. However, the head portions of the fasteners which are exposed to atmospheric conditions must be provided with a supplemental corrosion resistant coating.

In the representative process for forming sheet metal fasteners utilizing galvanized sheet metal which has been pre-coated with corrosion resistant materials along pre-determined surface portions, the sheet metal exiting the coil coating apparatus 10 will first be severed into 3 separate coils. By way of example, the original width of the galvanized sheet metal may be approximately 12 inches. However, after being pre-coated with the corrosion resistant materials as shown in FIG. 3, the sheet metal will be cut at two points such as shown at $C_1$ and $C_2$ in FIG. 3 to form three separate coils each being approximately 4" in width.

Figure 4:
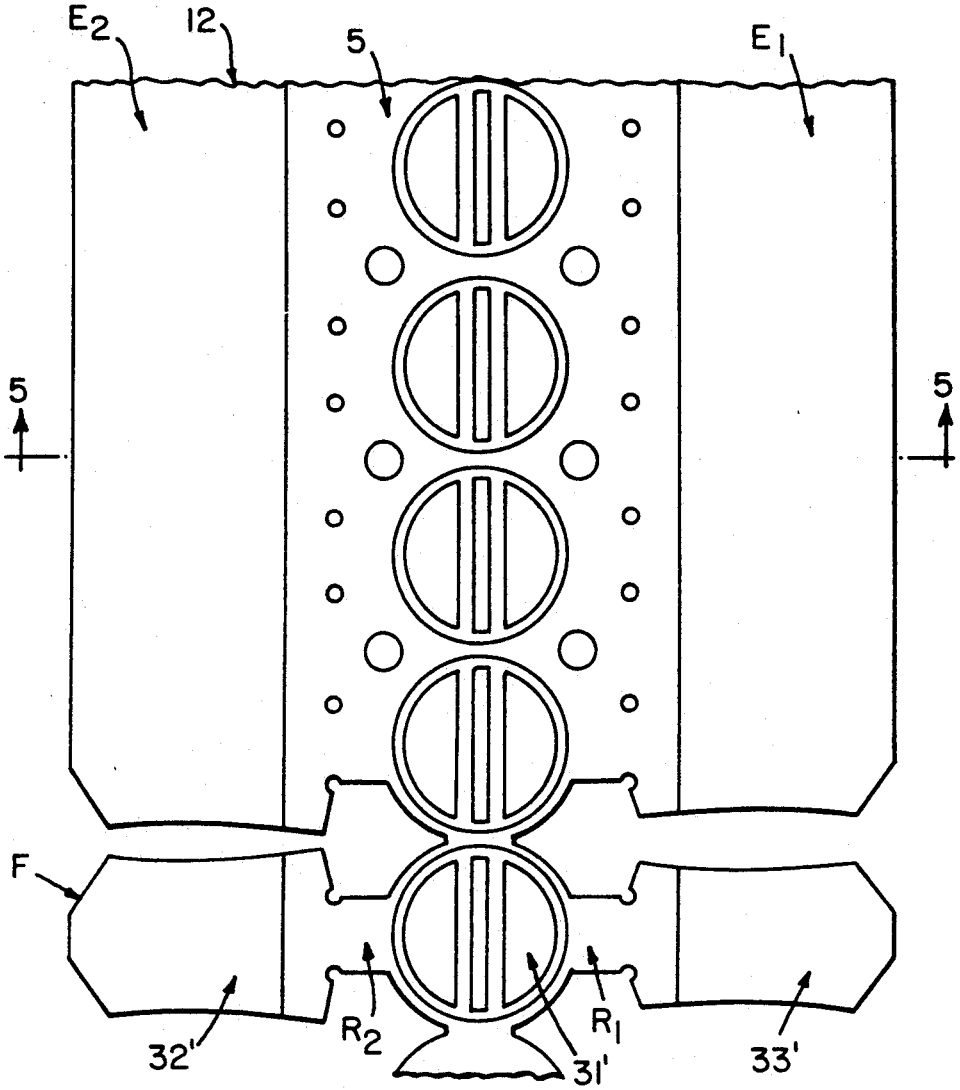
FIG. 4 is an enlarged top plan view of a portion of an elongated strip of coated sheet metal material as severed from the sheet metal shown in FIG. 3 generally along the lines shown in 4–4 thereof and showing the strip as it is subsequently punched and cut in the area of the coated stripes applied to the sheet metal in FIG. 3 and in the preliminary formation of a sheet metal roofing fastener.
Figure 5:
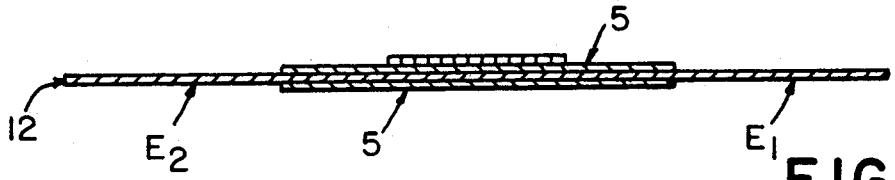
FIG. 5 is an enlarged cross section taken along line 5—5 of FIG. 4.

With specific reference to FIG. 4, a top plan view of a strip or width of the galvanized sheet metal as severed at $C_1$ and $C_2$ of FIG. 3 is disclosed. It is noted that the sheet metal is coated along the upper and lower surfaces and along the central portion thereof with the coating stripe S, leaving the outer edges E1 and E2 uncoated. During the manufacturing process, the central portion of the strip of material will be stamped to form the head portion of the fastener 31 (see FIG. 6), and thereafter portions of the sheet metal will be punched to form individual fastener blanks F. Each fastener blank F includes a head portion 31' and shank or leg portions 32' and 33' which are connected by head reinforcing sections R1 and R2. In the manufacturing process the reinforcing sections R1 and R2 are folded underneath the head portion 31' and function as part of the head 31 of the finished fastener shown in FIG. 6. In view of this, the reinforcing sections R1 and R2 should be coated as they may be exposed to atmospheric conditions and are thus formed within the pre-coated area S of the strip of material.

Figure 6:
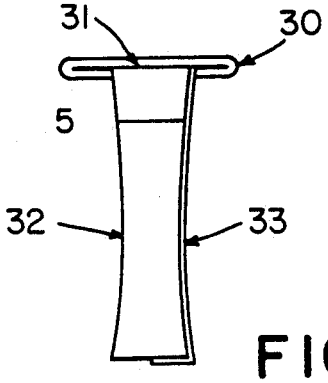
FIG. 6 is a front elevational view of a sheet metal fastener formed from the coated and punched material of FIG. 4 showing the head of the fastener being coated and with the shank or leg portions of the fastener not being coated with the corrosion resistant material.

Once the blanks F of sheet metal fasteners are severed from one another they are formed into the finished fastener shown in FIG. 6. The fastener includes a head portion 31 from which extend spreadable legs or shanks 32 and 33 each of which is generally U-shaped in cross section with the shank 33 being seated within the shank 32. As shown in FIG. 6, the head 31 is coated with the corrosion resistant material 11 (from FIG. 1) and only the upper most portion of the legs 32 and 33 have the coating applied thereto so that the remaining portion of the shanks remain free of coating leaving their galvanized surface free to chemically react with the cementitious materials into which the fasteners are driven thereby allowing a strong chemical bond to develop between the fasteners and the material.

As previously discussed, the process of the present invention of selectively applying corrosion resistant coatings to sheet metal prior to the sheet metal being formed into an end product is not limited to the field of sheet metal fasteners. Other products may include siding, awnings and trim fittings for housing, trailers, mobile homes and the like as well as appliances, heating and air conditioning, and other air vents and the like.

I claim:

1. A method of forming a product having localized corrosion protection, the product being composed of sheet metal having a corrosion resistant coating and including at least one exterior surface being substantially covered by said coating, the method comprising the steps of:

passing a coil of sheet metal through a coil coater and applying a plurality of stripes of a corrosion resistant coating to a surface of said sheet metal such that only a portion of said surface is coated with said corrosion resistant coating, the remainder of said surface remaining as substantially uncoated sheet metal;

curing said plurality of stripes of said corrosion resistant coating; and subsequently forming said product from said sheet metal such that said product comprises at least one exterior surface being substantially covered by said corrosion resistant coating.

2. The method of claim 1, wherein said step of passing includes applying said plurality of stripes of said corrosion resistant coating in a spaced relationship relative to each other.

3. The method of claim 1, wherein said step of passing includes applying a plurality of stripes of said corrosion resistant material in a spaced relationship relative to each other to an upper and a lower surface of said sheet metal such that only a portion of said upper surface and said lower surface is coated.

4. The method of claim 2, wherein said step of passing includes applying a plurality of stripes of said corrosion resistant material in a spaced relationship relative to each other to an upper and a lower surface of said sheet metal such that only a portion of said upper surface and said lower surface is coated.

* * * * *